US009157331B2

(12) United States Patent
Laurello

(10) Patent No.: US 9,157,331 B2
(45) Date of Patent: Oct. 13, 2015

(54) RADIAL ACTIVE CLEARANCE CONTROL FOR A GAS TURBINE ENGINE

(75) Inventor: Vincent P. Laurello, Hobe Sound, FL (US)

(73) Assignee: Siemens Aktiengesellschaft, München (DE)

( * ) Notice: Subject to any disclaimer, the term of this patent is extended or adjusted under 35 U.S.C. 154(b) by 808 days.

(21) Appl. No.: 13/314,296

(22) Filed: Dec. 8, 2011

(65) Prior Publication Data

US 2013/0149123 A1 Jun. 13, 2013

(51) Int. Cl.
*F01D 25/14* (2006.01)
*F01D 11/24* (2006.01)

(52) U.S. Cl.
CPC ..... *F01D 11/24* (2013.01); *F05D 2260/201* (2013.01); *F05D 2270/20* (2013.01)

(58) Field of Classification Search
CPC ..... F01D 9/06; F01D 11/025; F01D 11/08; F01D 11/20; F01D 11/24; F01D 25/14; F05D 2260/201; F05D 2270/07; F05D 2270/20
USPC ..... 415/108, 110, 173.2
See application file for complete search history.

(56) References Cited

U.S. PATENT DOCUMENTS 3,966,354 A * 6/1976 Patterson ..... 415/116
4,019,320 A * 4/1977 Redinger et al. ..... 60/226.1
4,230,436 A * 10/1980 Davison ..... 415/1
4,485,620 A * 12/1984 Koenig et al. ..... 60/806
4,683,716 A * 8/1987 Wright et al. ..... 60/226.1
4,762,462 A * 8/1988 Lardellier ..... 415/177
4,849,895 A 7/1989 Kervistin
5,048,288 A 9/1991 Bessette et al.
5,100,291 A * 3/1992 Glover ..... 415/115
5,205,115 A * 4/1993 Plemmons et al. ..... 60/806
5,351,732 A * 10/1994 Mills et al. ..... 415/175
5,779,436 A 7/1998 Glezer et al.
6,925,814 B2 8/2005 Wilson et al.
7,503,179 B2 * 3/2009 Estridge et al. ..... 60/782
7,597,537 B2 10/2009 Bucaro et al.
2007/0140838 A1 6/2007 Estridge et al.
2009/0208321 A1 * 8/2009 O'Leary ..... 415/14
2010/0247297 A1 * 9/2010 Legare et al. ..... 415/173.1

FOREIGN PATENT DOCUMENTS

EP 1978382 A2 10/2008
FR 2949808 A1 3/2011
GB 1581566 A 12/1980
GB 2089439 A 6/1982
WO 9211444 A1 7/1992
WO 2004097181 A1 11/2004

* cited by examiner

*Primary Examiner* — Sean J Younger

(57) ABSTRACT

The present invention comprises a gas turbine engine with a compressor for generating compressed air, a turbine comprising upstream and downstream rows of vanes, vane carrier structure surrounding at least one row of vanes and plenum structure at least partially surrounding the vane carrier structure capable of impinging compressed air onto the vane carrier structure. The gas turbine engine further comprises fluid supply structure including first fluid path structure defining a first path for compressed air to travel to the plenum structure, second fluid path structure defining a second path for compressed air to travel toward the downstream row of vanes, and fluid control structure selectively controlling fluid flow to the first and second fluid path structures.

16 Claims, 3 Drawing Sheets

RADIAL ACTIVE CLEARANCE CONTROL FOR A GAS TURBINE ENGINE

FIELD OF THE INVENTION

This invention relates in general to a gas turbine engine and structure for variably directing compressed air onto a gas turbine engine vane carrier.

BACKGROUND OF THE INVENTION

Controlling gas turbine engine blade tip clearance is desirable so as to establish high turbine efficiency. Turbine efficiency improves as the clearance or gap between turbine blade tips and a surrounding static structure is minimized. During transient operations, the blade tips respond to the temperature of the hot working gases at different rates than the static structure. The difference in response results in the transient clearances being "pinched" such that the clearance at the transient time point is tighter than the clearance at steady state operation. In addition, during transient conditions such as during shutdown, the engine casing can thermally distort which results in local "pinching." Although the casing is less distorted at steady state, the transient distortion effect must be considered when determining proper blade tip clearance. Since the majority of the gas turbine engine running time occurs during steady state operation, allowing clearance for the transient distortion effect results in a performance penalty at steady state.

SUMMARY OF THE INVENTION

In accordance with a first aspect of the present invention, a gas turbine engine is provided comprising: an engine casing; a compressor for generating compressed air; a turbine; and fluid supply structure. The turbine may comprise: at least one upstream row of vanes; at least one downstream row of vanes downstream from the at least one upstream row of vanes; vane carrier structure surrounding at least one row of vanes; and impingement plenum structure at least partially surrounding the vane carrier structure capable of impinging compressed air onto the vane carrier structure. The fluid supply structure may comprise: first fluid path structure defining a first path for compressed air to travel to the impingement plenum structure; second fluid path structure defining a second path for compressed air to travel toward the at least one downstream row of vanes; and fluid control structure selectively controlling fluid flow to the first and second fluid path structures.

The fluid control structure may permit compressed air to flow through the first fluid path structure during a steady state operation of the gas turbine engine and permit compressed air to flow through the second fluid path structure during a transient operation of the gas turbine engine.

The engine casing and the vane carrier structure may define an internal chamber in which the plenum structure is located. Compressed air passing through the first fluid path structure flows into the plenum structure, passes from the plenum structure so as to impinge on the vane carrier structure and travels through bores in the vane carrier structure to the at least one downstream row of vanes.

The gas turbine engine further comprises: at least one downstream row of blades, and at least one downstream ring segment structure surrounding the at least one downstream row of blades. The at least one downstream ring segment structure and the vane carrier structure define at least one downstream inner cavity. The at least one downstream inner cavity may receive compressed air from the internal chamber.

In accordance with a first embodiment, the fluid control structure may comprise a valve controlling fluid flow to the first and second fluid path structures.

The plenum structure may comprise: at least one impingement manifold; and a plurality of impingement tubes coupled to and communicating with the impingement manifold. The impingement tubes may be axially spaced apart from one another.

Each of the impingement tubes may be sized such that less compressed air is provided by an impingement tube the more downstream the impingement tube is located.

In accordance with a second embodiment of the present invention, the fluid control structure may comprise a first valve controlling fluid flow through the first fluid path structure and a second valve controlling fluid flow through the second fluid path structure.

In accordance with a second aspect of the present invention, a gas turbine engine is provided comprising: an engine casing; a compressor for generating compressed air; a turbine; and fluid supply structure. The turbine may comprise: at least one upstream row of vanes and at least one downstream row of vanes; vane carrier structure surrounding at least one row of vanes; and plenum structure at least partially surrounding the vane carrier structure capable of impinging compressed air onto the vane carrier structure. The fluid supply structure may comprise: first fluid path structure defining a first path for compressed air to travel to the plenum structure; second fluid path structure defining a second path for compressed air to travel toward the at least one downstream row of vanes; and fluid control structure capable of permitting compressed air to flow through one of the first fluid path structure and the second fluid path structure. The fluid control structure may permit compressed air to flow through the first fluid path structure during a steady state operation of the gas turbine engine and may permit compressed air to flow through the second fluid path structure during a transient operation of the gas turbine engine.

The engine casing and the vane carrier structure may define an internal chamber in which the plenum structure is located. Compressed air passing through the first fluid path structure flows into the plenum structure, and passes from the plenum structure into the internal chamber.

The gas turbine engine may further comprise: at least one downstream row of blades, and at least one downstream ring segment structure surrounding the at least one downstream row of blades. The at least one downstream ring segment structure and the vane carrier structure may define at least one downstream inner cavity. The at least one downstream inner cavity may receive compressed air from the internal chamber.

In accordance with a first embodiment of the present invention, the fluid control structure may comprise a valve controlling fluid flow to the first and second fluid path structures.

The impingement plenum may comprise: at least one impingement manifold; and a plurality of impingement tubes coupled to and communicating with the impingement manifold. The impingement tubes may be axially spaced apart from one another.

Each of the impingement tubes may be sized such that less compressed air is provided by an impingement tube the more downstream the impingement tube is located.

The vane carrier structure may comprise at least one radially outwardly extending rail, and wherein at least one of the impingement tubes may direct air such that it impinges on the at least one rail.

In accordance with a second embodiment of the present invention, the fluid control structure may comprise a first valve controlling fluid flow through the first fluid path structure and a second valve controlling fluid flow through the second fluid path structure.

In accordance with a third aspect of the present invention, a gas turbine engine is provided comprising: an engine casing; a compressor for generating compressed air; a turbine; and fluid supply structure. The turbine may comprise: at least one upstream row of vanes; at least one downstream row of vanes downstream from the at least one upstream row of vanes; vane carrier structure surrounding at least one row of vanes; and plenum structure at least partially surrounding the vane carrier structure for impinging compressed air onto the vane carrier structure. The plenum structure may comprise: at least one impingement manifold; and first and second impingement tubes coupled to and in communication with the manifold. The first tube may be located nearer to the compressor than the second tube and the first tube may have a cross-sectional area greater in size than the second tube such that the first tube delivers a greater amount of compressed air than the second tube. The fluid supply structure may comprise: first fluid path structure defining a first path for compressed air to travel to the plenum structure; second fluid path structure defining a second path for compressed air to travel toward the at least one downstream row of vanes; and fluid control structure selectively controlling fluid flow to the first and second fluid path structures.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
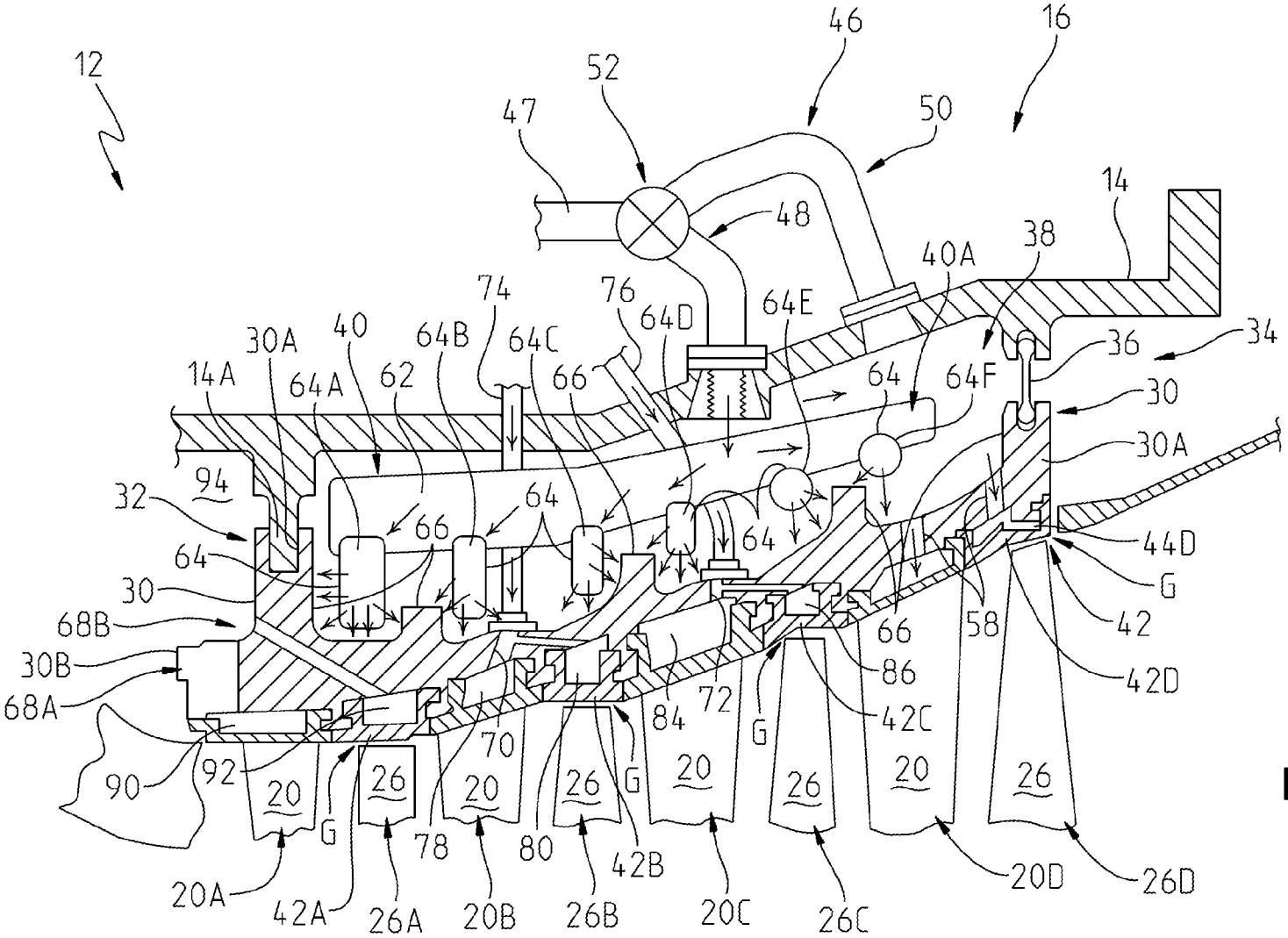
FIG. 1 is a partial cross-sectional view of a gas turbine engine constructed in accordance with a first embodiment of the present invention wherein fluid flow is shown passing into a plenum structure.
Figure 2:
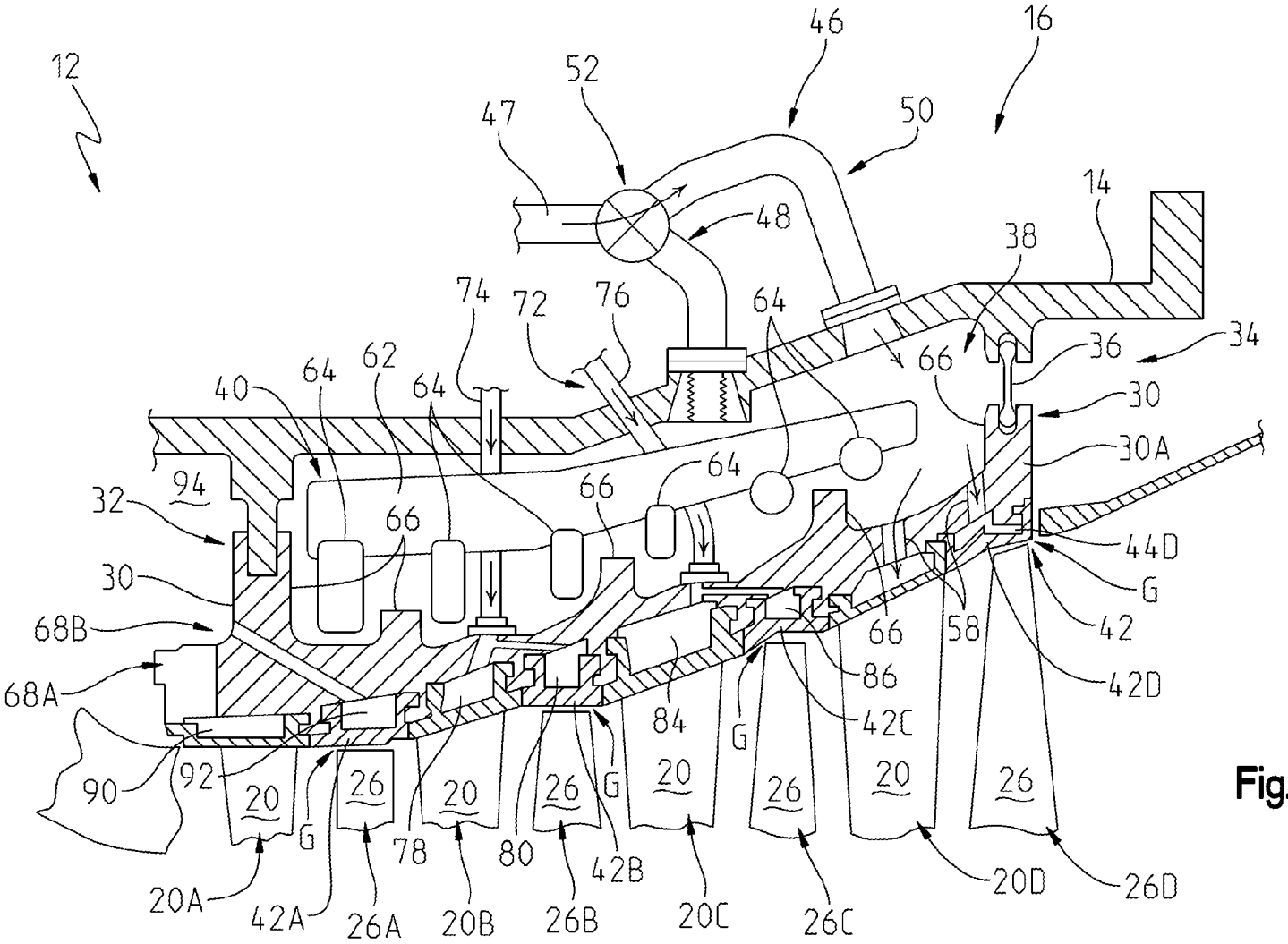
FIG. 2 is a partial cross-sectional view of the gas turbine engine in FIG. 1 wherein fluid flow is shown passing toward a downstream row of vanes.

Reference is now made to FIGS. 1 and 2, which shows a turbine 16 of an industrial gas turbine engine 12. The gas turbine engine 12 of the illustrated embodiment comprises an engine casing 14, a compressor (not shown), and the turbine 16. The engine casing 14 surrounds the turbine 16. The compressor (not shown) generates compressed air, at least a portion of which is delivered to an array of combustors (not shown) arranged axially between the compressor and the turbine 16. The compressed air generated from the compressor is mixed with fuel and ignited in the combustors to provide hot working gases to the turbine 16. The turbine 16 converts energy in the form of heat from the hot working gases into, rotational energy.

The turbine 16 of the present invention comprises at least one upstream row of vanes 20 and at least one downstream row of vanes 20 downstream from the at least one upstream row of vanes 20. The illustrated embodiment of the present invention comprises three upstream rows 20A-20C of vanes 20 and one downstream row 20D of vanes 20, as shown in FIGS. 1 and 2. Further, the turbine 16 of the present invention comprises a turbine rotor (not shown) comprising at least one upstream row of blades 26 and at least one downstream row of blades 26. The illustrated embodiment shown in FIGS. 1 and 2 comprises first, second and third upstream rows 26A-26C of blades 26 and a fourth downstream row 26D of blades 26.

Vane carrier structure 30 surrounds and supports the upstream rows 20A-20C of vanes 20 and the downstream row 20D of vanes 20. The vane carrier structure 30 in the illustrated embodiment comprises upper and lower halves, wherein only the upper half 30A is illustrated in FIGS. 1 and 2. Each upper and lower half comprises, in the illustrated embodiment, an axially extending integral part. Alternatively, the vane carrier structure may comprise multiple, axially-separated sections (not shown). The vane carrier structure 30 may be supported at an upstream location 32 and a downstream location 34 by structure that allows for radial and/or axial movement. In the illustrated embodiment of FIGS. 1 and 2, the vane carrier structure 30 is supported by the engine casing 14 at an upstream location 32 via an engine casing circumferential member 14A extending radially downward into a circumferential receiving groove 30A provided in the vane carrier structure 30. The vane carrier structure 30 is capable of radial movement related to the engine casing circumferential member 14A. A "dog bone" seal 36 is utilized at a downstream location 34 to allow axial and/or radial end movement of the vane carrier structure 30 relative to the engine casing 14 while providing structural and sealing characteristics.

The engine casing 14 and vane carrier structure 30 define an internal chamber 38 in which a plenum structure 40 is located. The plenum structure 40 at least partially surrounds the vane carrier structure 30. In the illustrated embodiment, the plenum structure 40 comprises upper and lower separate plenum units (only the upper plenum unit 40A is shown in FIGS. 1 and 2), each circumferentially spanning about 180 degrees inside the internal chamber 38. The plenum structure 40 may be capable of impinging compressed air onto the vane carrier structure 30 to effect cooling of the vane carrier structure 30.

The gas turbine engine assembly 12 further comprises first, second, third and fourth ring segment structures 42A-42D. The first, second and third ring segment structures 42A-42C are generally axially aligned with and radially spaced a small distance from the first, second and third upstream rows 26A-26C of blades 26. The fourth ring segment structure 42D is generally axially aligned with and radially spaced a small distance from the downstream row 26D of blades 26.

The fourth ring segment structure 42D and the vane carrier structure 30 define a downstream inner cavity 44D, which receives compressed air from the internal chamber 38.

The gas turbine assembly 12 of the illustrated embodiment further comprises fluid supply structure 46 configured to communicate with the compressor to supply compressed air from the compressor to the turbine 16. Rather than being sent through the combustors, compressed air in the fluid supply structure 46 bypasses the combustors.

The fluid supply structure 46 includes an intermediate fluid path structure 47, a first fluid path structure 48, a second fluid path structure 50 and a fluid control structure 52. The first fluid path structure 48 is coupled to the intermediate fluid path structure 47 and defines a first path for compressed air to travel to the plenum structure 40 while the second fluid path structure 50, which is also coupled to the intermediate fluid path structure 47, defines a second path for compressed air to travel into the internal chamber 38 so as to move in a direction toward the downstream inner cavity 44D and the downstream row of vanes 22. The fluid control structure 52 selectively controls fluid flow from the intermediate fluid path structure 47 to either the first fluid path structure 48 or the second fluid path structure 50. The fluid control structure 52 may comprise an electronically controlled multi-port solenoid valve, which, in a first position or state, allows all of the compressed air from the intermediate fluid path structure 47 to flow through the first fluid path structure 48 and in a second position or state allows all of the compressed air from the intermediate fluid path structure 47 to flow through the second fluid path structure 50.

The fluid control structure 52 may be positioned in the first position during a steady state operation of the gas turbine engine 12 to permit compressed air to flow through the first fluid path structure 48, such that little or no compressed air flows through the second fluid path structure 50, see FIG. 1. Compressed air flows from the first fluid path structure 48 to the plenum structure 40 to allow impingement of compressed air onto the vane carrier structure 30 adjacent one or more of the first, second and third rows 26A-26C of blades 26. In the illustrated embodiment, compressed air impinges upon the vane carrier structure 30 adjacent to the first, second and third rows 26A-26C of blades 26. Impingement of compressed air onto the vane carrier structure 30 adjacent one or more of the first, second, and third rows 26A-26C of blades effects cooling of the vane carrier structure 30 such that it moves radially inwardly. As the vane carrier structure 30 moves radially inwardly, gaps G between the tips of one or more of the first, second, and third rows 26A-26C of blades 26 and adjacent inner surfaces of the first, second, and third ring segment structures 42A-42C become smaller, resulting in an increase in the efficiency of the gas turbine engine 12. It is also believed that a gap between the fourth row 26D of blades 26 and the fourth ring segment 42D may also become smaller due to the compressed cooling air impinging upon the vane carrier structure 30. After impinging onto the vane carrier structure 30, the compressed air flows through bores 58 in the vane carrier structure 30 to the downstream row 20D of vanes 22 and the downstream inner cavity 44D, as shown in FIG. 1.

The fluid control structure 52 may be positioned in the second position when the gas turbine engine 12 is in a transient state of operation, such as during engine start-up or shut-down, to permit the flow of compressed air through the second fluid path structure 50, see FIG. 2. Preferably, the fluid control structure 52 is positioned in the second position to permit the compressed air flowing through the intermediate fluid path structure 47 to flow through the second fluid path structure 50 such that little or no compressed air flows through the first fluid path structure 48. Since little or no compressed air directly impinges upon the vane carrier structure 30 adjacent the first, second and third rows 26A-26C of blades 26, the vane carrier structure 30 generally remains in a radially expanded state during a transient state of gas turbine engine operation. Hence, gaps G between the tips of the first, second, and third rows 26A-26C of blades 26 and adjacent inner surfaces of the first, second, and third ring segment structures 42A-42C remain expanded such that the blade tips do not mechanically contact, engage or rub against the inner surfaces of the first, second, and third ring segment structures 42A-42C during the transient state of the gas turbine engine.

A transient state of operation may include engine cold startup, engine warm/hot startup or engine shutdown. When the fluid control structure 52 is positioned in the second position, the compressed air flows from the second fluid path structure 50 into the internal chamber 38 before travelling through the bores 58 in the vane carrier structure 30 to the downstream row 20D of vanes 20 and to the downstream inner cavity 44D, as shown in FIG. 2.

As noted above, the plenum structure 40 may comprise upper and lower separate plenum units. Each plenum unit comprises in the illustrated embodiment an impingement manifold 62 and a plurality of impingement tubes 64 coupled to and communicating with the impingement manifold 62. As shown in FIGS. 1 and 2, the upper plenum unit 40A comprises one impingement manifold 62 and first, second, third, fourth, fifth and sixth impingement tubes 64A-64F. The impingement tubes 64A-64F are axially spaced apart from one another at an inner side of the impingement manifold 62.

In the illustrated embodiment, each of the impingement tubes 64A-64F is sized such that less compressed air is provided by an impingement tube 64 the more downstream the impingement tube 64 is located. As shown in FIGS. 1 and 2, the impingement tubes 64A-64C that are located closer to the compressor (i.e., located farther to the left in FIGS. 1 and 2) are generally defined by a cross-sectional area greater in size than the impingement tubes 64D-64F that are located farther away from the compressor (i.e., located farther to the right in FIGS. 1 and 2). The larger cross-sectional area of the impingement tubes located closer to the compressor allows delivery of a greater amount of compressed air than the amount delivered by the impingement tubes located farther from the compressor, which results in a higher amount of convective heat transfer at the upstream portion of the vane carrier structure 30. It is also noted that a first portion of the vane carrier structure 30 nearest the first and second rows 26A and 26B of blades 26 typically receives more energy in the form of heat during engine operation than a second portion of the vane carrier structure 30 nearest the fourth row 26D of blades. Hence, it is preferable to provide a greater amount of compressed air to the vane carrier structure first portion to cool the first portion.

The vane carrier structure 30 of the present invention may comprise at least one radially outwardly extending rail 66. The illustrated embodiment of FIGS. 1 and 2 comprises three impingement rails 66. The impingement tubes 64A-64F in the illustrated embodiment direct compressed air such that air impinges directly onto the rails 66. Due to the radially-extending geometry of the impingement rails 66, the rails 66 serve as elements to aid in contraction of the vane carrier structure 30 when they are impinged upon by compressed cooling air.

The illustrated embodiment of FIGS. 1 and 2 further comprises circumferentially spaced-apart notches 68A and cooling passages 70, 72 in the vane carrier 30 for providing cooling air to the first, second and third upstream rows 20A-20C of vanes 20. A first stage vane inner cavity 90 receives compressed air from an end or exit section of the compressor, which air flows into the inner cavity 90 via the circumferentially spaced-apart notches 68A. The first stage ring segment inner cavity 92 is supplied, in the illustrated embodiment, by compressed air flowing through the cooling passages 68B, which receive compressed air from the end or exit section of the compressor. Compressed air, preferably originating from a mid-compressor location (not shown), extends into a second stage conduit 74 and a third stage conduit 76. The second stage conduit 74 provides cooling air to the cooling passage 70, which communicates with a second stage vane inner cavity 78 located between the vane carrier structure 30 and the second upstream row 20B of vanes 20 and into a second stage ring segment inner cavity 80 located between the vane carrier structure 30 and the second upstream ring segment structure 42B. The third stage conduit 76 provides cooling air to the cooling passage 72, which communicates with a third stage vane inner cavity 84 located between the vane carrier structure 30 and the third upstream row 20C of vanes 20 and into a third stage ring segment inner cavity 86 located between the vane carrier structure 30 and the third upstream ring segment structure 42C. Compressed air that is supplied to the first, second and third upstream rows 20A-20C of vanes 20 and the downstream row 20D of vanes 20 enters and cools each vane through an internal vane cooling circuit (not shown). Finally, the compressed air escapes the vane internal vane circuit at the vane inner platform to additionally cool an inter-stage seal.

The circumferentially spaced-apart notches 68A further function to prevent radial growth of a first portion 30B of the vane carrier 30. As the vane carrier first portion 30B increases in temperature, the vane carrier first portion 30B expands circumferentially rather than radially. It is noted that the cooling air flowing through the notches 68A is at a higher temperature than the cooling air flowing through the passages 70 and 72 and the impingement tubes 64. The notches 68A are believed to prevent radial expansion of the first portion 30B of the vane carrier since it is being cooled with compressed air at a higher temperature than the air cooling the intermediate and end portions of the vane carrier 30.

Figure 3:
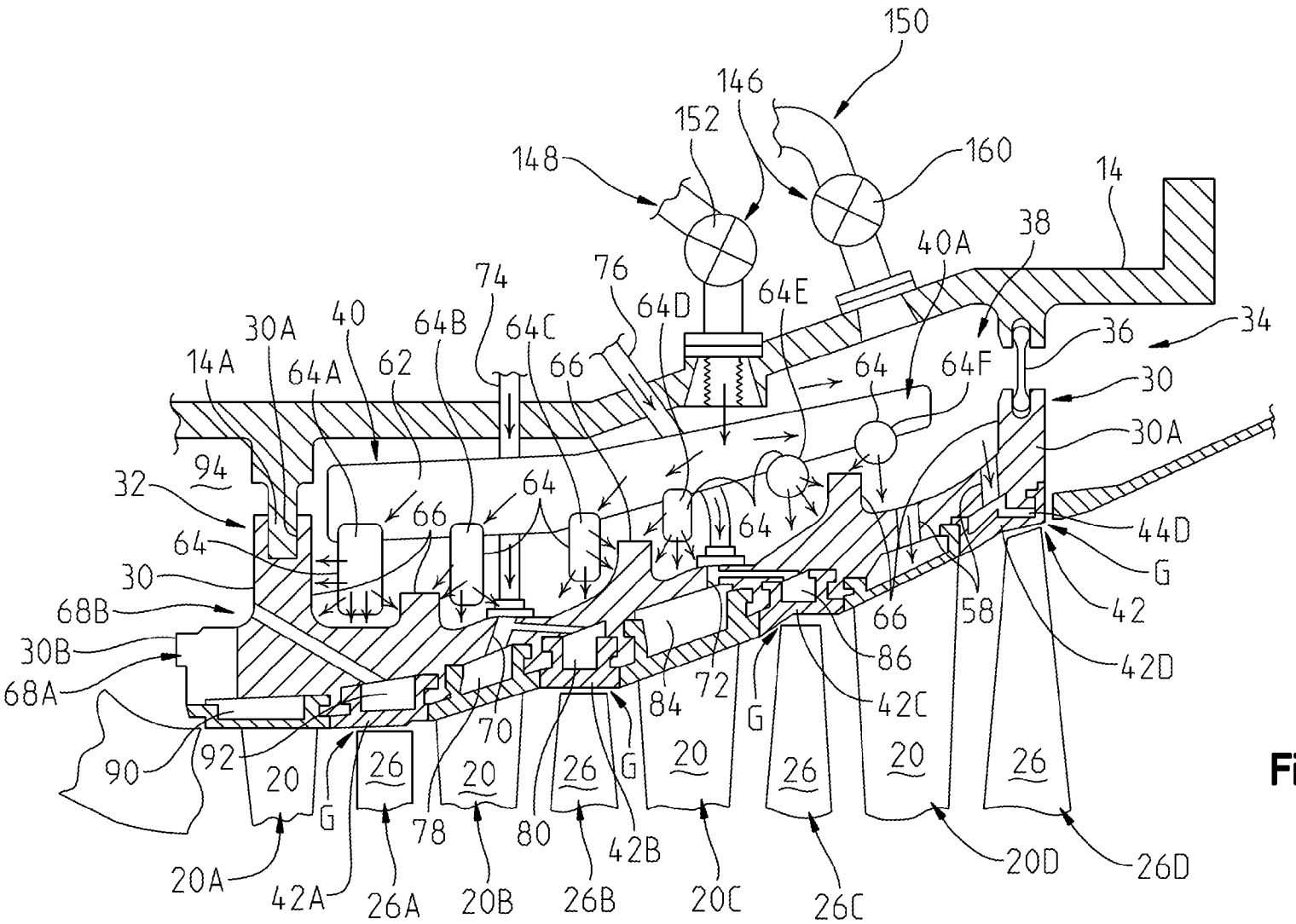
FIG. 3 is a partial cross-sectional view of a gas turbine engine constructed in accordance with a second embodiment of the present invention.

A second embodiment of the present invention is illustrated in FIG. 3, where elements common to the embodiment of FIG. 3 and the embodiment of FIGS. 1 and 2 are referenced by the same reference numerals. In the FIG. 3 embodiment, a fluid control structure 146 is provided comprising a first ON/OFF valve 152 in a first fluid path structure 148 and a second ON/OFF valve 160 in a second fluid path structure 150. Preferably, the pressure of compressed air flowing through the second fluid path structure 150 is less than the pressure of the compressed air flowing through the first fluid path structure 148. The pressure difference between the air flowing through the first and second fluid path structures 148 and 150 may be accomplished by taking compressed air from two different source locations along the compressor, wherein the two different source locations output compressed air at different pressures.

The first fluid path structure 148 defines a first path for compressed air to travel to the plenum structure 40 while the second fluid path structure 150 defines a second path for compressed air to travel into the internal chamber 38 so as to move in a direction toward the downstream inner cavity 44D and the downstream row 20D of vanes 20. The first valve 152 is turned ON and the second valve 160 is turned OFF during a steady state operation of the gas turbine engine to permit compressed air to flow through the first fluid path structure 148 to the plenum structure 40. The first valve 152 is turned OFF and the second valve 160 is turned ON during a transient operation of the gas turbine engine to permit compressed air to flow through the second fluid path structure 150. It is believed that there is a pressure drop as compressed air passes through the plenum structure 40. Preferably, the increase in pressure of the air passing through the first fluid path structure 148 over the pressure of the air passing through the second fluid path structure 150 generally equals the pressure drop occurring within the plenum structure 40. Hence, the pressure and flow rate of the compressed air reaching the fourth row 20D of vanes 20 is generally the same regardless of whether the first valve 152 is turned ON or the second valve 160 is turned ON.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine comprising:

an engine casing;

a compressor for generating compressed air;

a turbine comprising:

at least one upstream row of vanes;

a downstream row of vanes downstream from said at least one upstream row of vanes;

vane carrier structure surrounding at least one of said rows of vanes; and plenum structure at least partially surrounding said vane carrier structure capable of impinging compressed air onto said vane carrier structure; and fluid supply structure comprising:

first fluid path structure defining a first path for compressed air to travel to said plenum structure;

second fluid path structure defining a second path for compressed air to travel toward said downstream row of vanes; and fluid control structure selectively controlling fluid flow to said first and second fluid path structures;

wherein said engine casing and said vane carrier structure define an internal chamber in which said plenum structure is located, compressed air passing through said first fluid path structure flows into said plenum structure, and passes from said plenum structure so as to impinge on said vane carrier structure within said internal chamber;

at least one conduit extending from said compressor, through said internal chamber, to a passage through said vane carrier providing cooling air from said compressor to an interior of vanes forming said at least one upstream row of vanes;

said fluid control structure alternately providing a flow of compressed air from said first and second fluid path structures to said internal chamber; and a bore through said vane carrier adjacent to said downstream row of vanes defining a flow path for air from said internal chamber to an interior of vanes forming said downstream row of vanes during flow of compressed air from both said first and second fluid path structures.

2. The gas turbine engine as set forth in claim 1, said fluid control structure permitting compressed air to flow through said first fluid path structure during a steady state operation of said gas turbine engine and permitting compressed air to flow through said second fluid path structure during a transient operation of said gas turbine engine.

3. The gas turbine engine as set forth in claim 1, further comprising:

at least one downstream row of blades; and at least one downstream ring segment structure surrounding said at least one downstream row of blades, said at least one downstream ring segment structure and said vane carrier structure defining at least one downstream inner cavity, said at least one downstream inner cavity receiving compressed air from said internal chamber.

4. The gas turbine engine as set forth in claim 1, wherein said fluid control structure comprises a valve receiving a compressed air flow from an intermediate fluid path structure and alternately controlling fluid flow out of said valve to both said first and second fluid path structures.

5. The gas turbine engine as set forth in claim 1, wherein said plenum structure comprises:

at least one impingement manifold; and a plurality of impingement tubes coupled to and communicating with said impingement manifold, said impingement tubes being axially spaced apart from one another.

6. The gas turbine engine as set forth in claim 5, wherein each of said impingement tubes is sized such that less compressed air is provided by each successive impingement tube the more downstream the impingement tube is located.

7. The gas turbine engine as set forth in claim 5, wherein said fluid control structure comprises a first valve controlling fluid flow through said first fluid path structure and a second valve controlling fluid flow through said second fluid path structure.

8. A gas turbine engine comprising:

an engine casing;

a compressor for generating compressed air;

a turbine comprising:

at least one upstream row of vanes and at least one downstream row of vanes;

vane carrier structure surrounding at least one of said rows of vanes; and plenum structure at least partially surrounding said vane carrier structure capable of impinging compressed air onto said vane carrier structure; and fluid supply structure comprising:

first fluid path structure defining a first path for compressed air from a source location on said compressor to travel to said plenum structure;

second fluid path structure defining a second path for compressed air from another source location on said compressor, different from and at a different pressure than said source location for said first fluid path structure, to travel toward said at least one downstream row of vanes; and fluid control structure capable of permitting compressed air to alternately flow through one of said first fluid path structure and said second fluid path structure, said fluid control structure comprises a first valve controlling fluid flow through said first fluid path structure and a second valve controlling fluid flow through said second fluid path structure, wherein said fluid control structure permits compressed air to flow through said first fluid path structure during a steady state operation of said gas turbine engine and permits compressed air to flow through said second fluid path structure during a transient operation of said gas turbine engine;

wherein said engine casing and said vane carrier structure define an internal chamber in which said plenum structure is located, compressed air passing through said first fluid path structure flows into said plenum structure, and passes from said plenum structure so as to impinge on said vane carrier structure within said internal chamber; and said second fluid path structure supplying compressed air through said second valve at a lower pressure during said transient operation of said gas turbine engine than a pressure of compressed air supplied by said first fluid path structure through said first valve during said steady state operation of said gas turbine engine.

9. The gas turbine engine as set forth in claim 8, further comprising:

at least one downstream row of blades; and at least one downstream ring segment structure surrounding said at least one downstream row of blades, said at least one downstream ring segment structure and said vane carrier structure defining at least one downstream inner cavity, said at least one downstream inner cavity receiving compressed air from said internal chamber.

10. The gas turbine engine as set forth in claim 8, wherein said plenum structure comprises:

at least one impingement manifold; and a plurality of impingement tubes coupled to and communicating with said impingement manifold, said impingement tubes being axially spaced apart from one another.

11. The gas turbine engine as set forth in claim 10, wherein each of said impingement tubes is sized such that less compressed air is provided by each successive impingement tube the more downstream the impingement tube is located.

12. The gas turbine engine as set forth in claim 10, wherein said vane carrier structure comprises at least one radially outwardly extending rail, and wherein at least one of said impingement tubes directs air such that it impinges on said at least one rail.

13. A gas turbine engine comprising:

an engine casing;

a compressor for generating compressed air;

a turbine comprising:

at least one upstream row of vanes;

at least one downstream row of vanes downstream from said at least one upstream row of vanes;

vane carrier structure surrounding at least one of said rows of vanes; and plenum structure at least partially surrounding said vane carrier structure for impinging compressed air onto said vane carrier structure, said plenum structure comprising:

at least one impingement manifold; and at least first, second and third impingement tubes coupled to and communicating with said at least one impingement manifold, said impingement tubes being axially spaced apart from one another wherein each successive first, second and third impingement tube, in the downstream direction, has a cross-sectional area that is less than an upstream adjacent impingement tube; and fluid supply structure comprising:

first fluid path structure defining a first path for compressed air to travel to said plenum structure;

second fluid path structure defining a second path for compressed air to travel toward said at least one downstream row of vanes; and fluid control structure selectively controlling fluid flow to said first and second fluid path structures to alternately permit compressed air flow through said first and second fluid path structures.

14. The gas turbine engine as set forth in claim 1, wherein said at least one conduit provides a flow of compressed air to said at least one upstream row of vanes separate from air flow in the internal chamber.

15. The gas turbine engine as set forth in claim 8, wherein a difference in pressure between the compressed air supplied through the first and second fluid path structures is generally equal to a pressure drop that occurs though said plenum structure as compressed air passes from said first fluid path structure to said internal chamber.

16. The gas turbine engine as set forth in claim 15, including a bore through said vane carrier adjacent to said at least one downstream row of vanes defining a flow path for air from said internal chamber to an interior of vanes forming said downstream row of vanes during flow of compressed air from both said first and second fluid path structures, wherein a pressure of compressed air provided to said at least one downstream row of vanes during flow of compressed air from said first fluid path structure is generally equal to pressure of compressed air provided to said at least one downstream row of vanes during flow of compressed air from said second fluid path structure.

* * * * *